US006551222B1

(12) United States Patent
Beaver

(10) Patent No.: US 6,551,222 B1
(45) Date of Patent: Apr. 22, 2003

(54) ADJUSTABLE SPEED BALL BEARING JUMP ROPE

(76) Inventor: Terry L. Beaver, 3701 Sleepy Hollow Rd., Punta Gorda, FL (US) 33950

( * ) Notice: Subject to any disclaimer, the term of this patent is extended or adjusted under 35 U.S.C. 154(b) by 0 days.

(21) Appl. No.: 10/166,504

(22) Filed: Jun. 11, 2002

(51) Int. Cl.[7] ..... A63B 5/20
(52) U.S. Cl. ..... 482/82
(58) Field of Search ..... 482/81, 82, 126

(56) References Cited

U.S. PATENT DOCUMENTS 233,224 A * 10/1880 Flynt ..... 482/81
438,484 A * 10/1890 Pringle ..... 482/81
932,331 A * 8/1909 Russell ..... 482/81
2,466,243 A 4/1949 Johnson
2,942,881 A 6/1960 Recalma
4,101,123 A * 7/1978 Anthony ..... 482/81
4,647,037 A * 3/1987 Donohue ..... 482/81
4,778,173 A * 10/1988 Joutras ..... 480/81

* cited by examiner

*Primary Examiner*—Jerome W. Donnelly
(74) *Attorney, Agent, or Firm*—Frank A. Lukasik

(57) ABSTRACT

A speed ball bearing jump rope construction with an adjustable rope length, the invention consisting of a pair of hollow handles having external grip surfaces, vent holes and a bearing assembly at one end of each handle fastened with a screw threaded into the handles. Screws mounted within each of the tops of the bearing assemblies permit the rope to slide to shorten the length.

2 Claims, 4 Drawing Sheets

ADJUSTABLE SPEED BALL BEARING JUMP ROPE

BACKGROUND OF THE INVENTION.

This invention relates primarily to jump ropes and more particularly to jump ropes using a ball bearing assembly connecting the rope to the handle.

While the structure of jump ropes has improved over the years from the beginning models which feature a simple rope. More sophisticated structures were then provided wherein a simple handle was tied or otherwise crudely attached to each end of the rope. More recently jump rope manufacturers have advertised and sold more sophisticated models having a variety of ball bearing attachments between the rope and the handle such as those disclosed in U.S. Pat. No. 4,101,123 issued to Anthony Jul. 18, 1978 and U.S. Pat. No. 5,749,812 issued to Feciura and Lee on May 12, 1998. In each of the latter, the use of a ball bearing attachment obviates earlier problems of the rope twisting against the handle or the users' hand which diminishes the play value of the jump rope. And while both of these inventions were vast improvements over prior art, they each have no means for easily adjusting the length of the jump rope or the speed at which can be rotated.

Modern jump ropes utilize a thin plastic coated flexible wire as the rope and the combination of this thin rope and a ball bearing attachment can raise the speed of rotation beyond the user's ability to manage it. This factor can also diminish the play value of the jump rope. The present invention seeks to improve on prior art ball bearing jump ropes by adding adjustment means for both the length of the rope and the speed at which it may be oscillated.

SUMMARY OF THE INVENTION.

The primary purpose of the invention is to provide a jump rope which can be adjustable as to the length of the rope and to the speed of oscillation.

It is a further purpose of the invention to provide a light weight hollow handle with a gripping surface and ventilation holes therein.

It is a further purpose of the invention to provide an adjustable friction brake to moderate the speed at which the jump rope spins.

It is a further object of the invention to provide an index spring and pawl to act as a stop against the rotation of the friction brake adjustment so that the brake will remain at a fixed tension during use.

It is a further object of the invention to provide a locking means to permit the jump rope to be adjusted in length and to remain fixed in length after such adjustment.

As will be seen from the annexed drawings and the description herein, the present invention provides a simple and efficient design of jump rope which effectively and inexpensively cures the deficiencies inherent in prior art jump ropes. Modern materials such as plastic covered flexible wire ropes are utilized in the present invention. Such materials improve the play value and longevity of the jump rope since they allow the jump rope to be used longer between rope replacements and, with adjustment, allow the jump rope to be configured in size and speed to accommodate children of various ages, sizes and skill level.

These and other objects of the present invention are provided in a jump rope construction which features a handle of cylindrical shape and including a closed end and an open end, a knurled surface hand grip and ventilation holes. In a first embodiment, the closed end is defined by a ball bearing assembly through which an attachment shaft is axially fitted so as to protrude and hold a boss for attachment of a thin flexible wire rope. A crimp screw perpendicular to the axis of the boss intersects a hole through the boss into which the wire is inserted and locked by tightening the crimp screw. Unlike prior art jump ropes whose handles are axially aligned with the rope, the present invention handles are perpendicular to the axis of the flexible wire giving a more comfortable hand position as the user swings the handles.

In a second, preferred, embodiment a friction brake is provided wherein the attachment shaft protrudes through a threaded cap. The cap has a knurled outer rim to provide a gripping means by which it can be turned. The cap has a friction pad attached which contacts the top of the bearing assembly as the cap is tightened. This acts to brake the rotation of the bearing assemble and thus the jump rope. The cap is retained in its frictional loading position by an index spring and pawl which permits minute adjustments to the braking tension on the bearing assembly.

DESCRIPTION OF A PREFERRED EMBODIMENT

Figure 1:
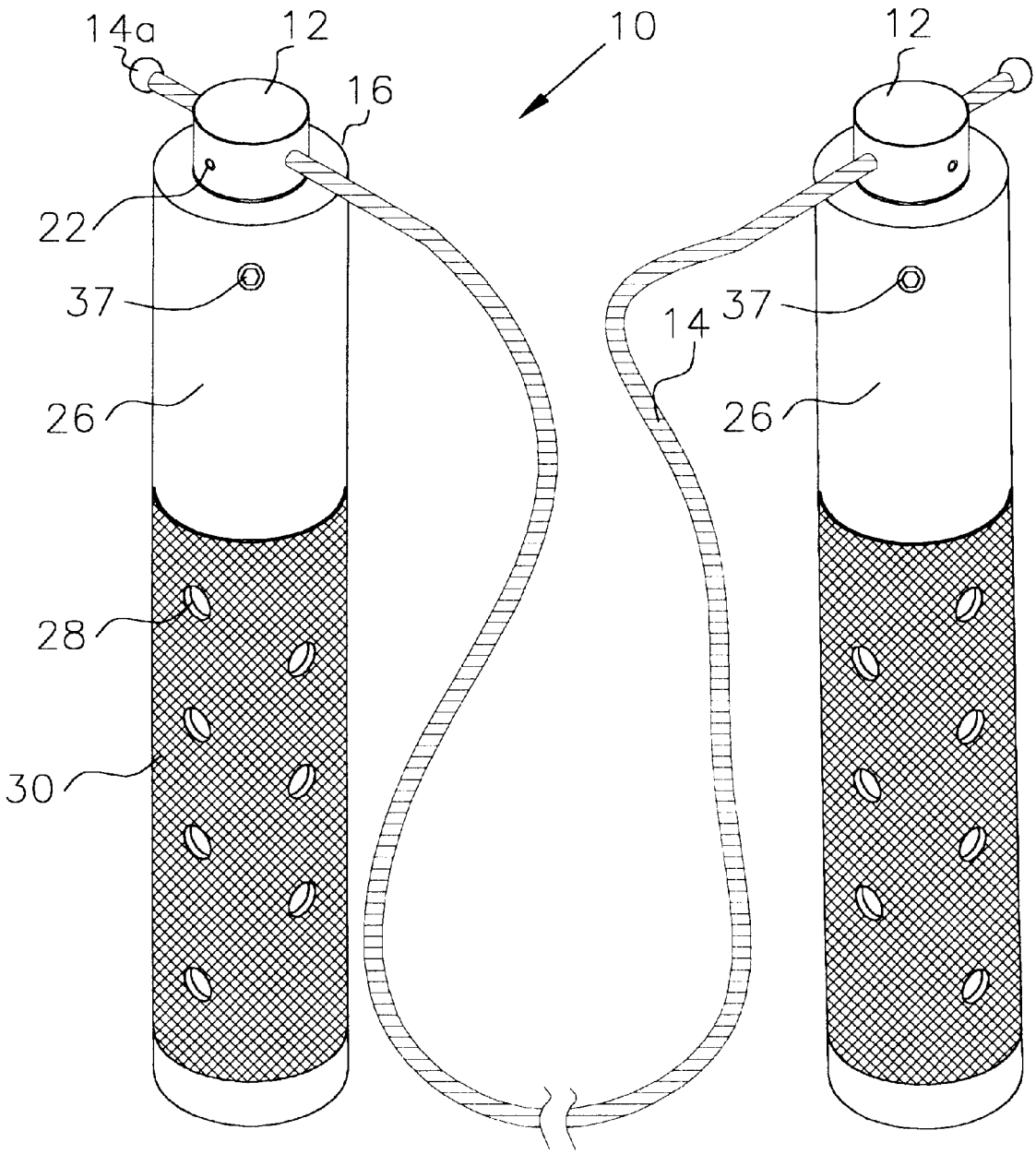
FIG. 1 is an isometric view of a preferred embodiment according to the invention showing a rope extending between two handles.
Figure 2:
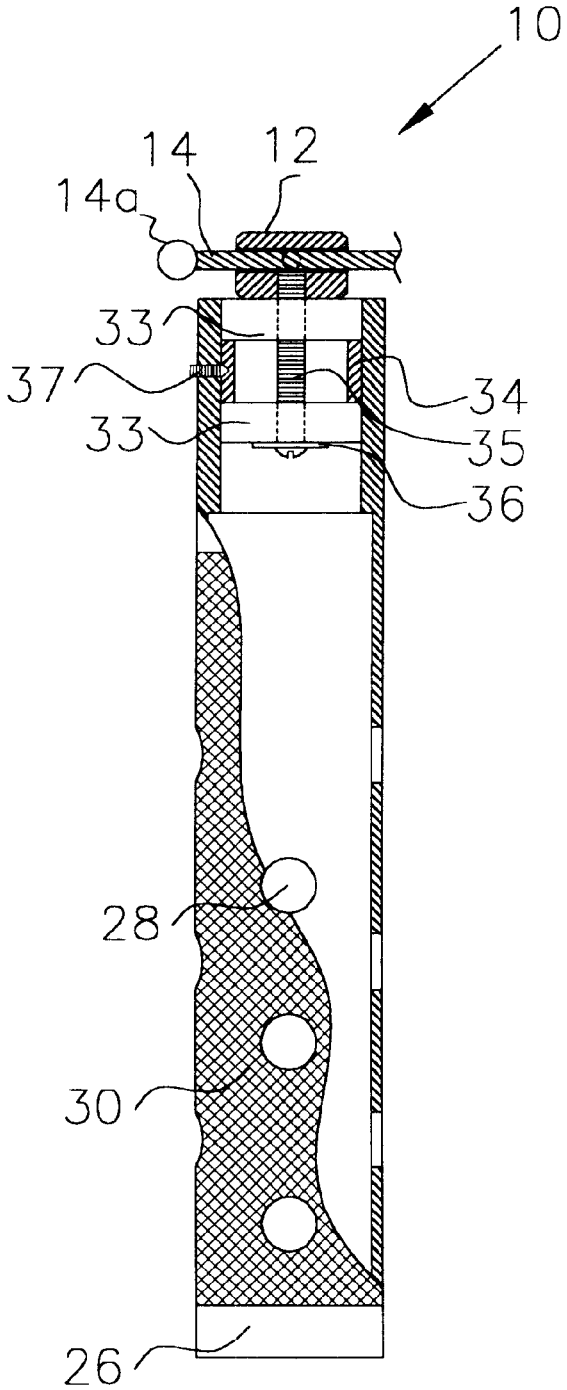
FIG. 2 is an elevational view, partially in section of the preferred embodiment showing the internal and external components and their relationship to the flexible jump rope.

Referring now to the drawings wherein like numerals correspond to like and corresponding parts throughout the several views, the invention is designated overall by the numeral 10. In FIG. 1, rope 14 extends between handles 26 through boss' 12. Rope end 14*a* stops rope 14 from accidentally dislodging when crimp screw 22 is undone. Vent holes 28 and knurled grip surface 30 provide comfort and cooling during use. Bearing assemblies 33 (FIG. 2) are retained in place with set screw 37 bearing against spacer 14. Screw bolt 35 holds the assembly of the two bearings 33, separated by spacer 34, and boss 12. The washer 36 attaches the two inner races of bearing assemblies 33 and boss 12 to provide the rotation of the rope 14 around the axis of screw bolt 35 when being used for jumping.

Figure 3:
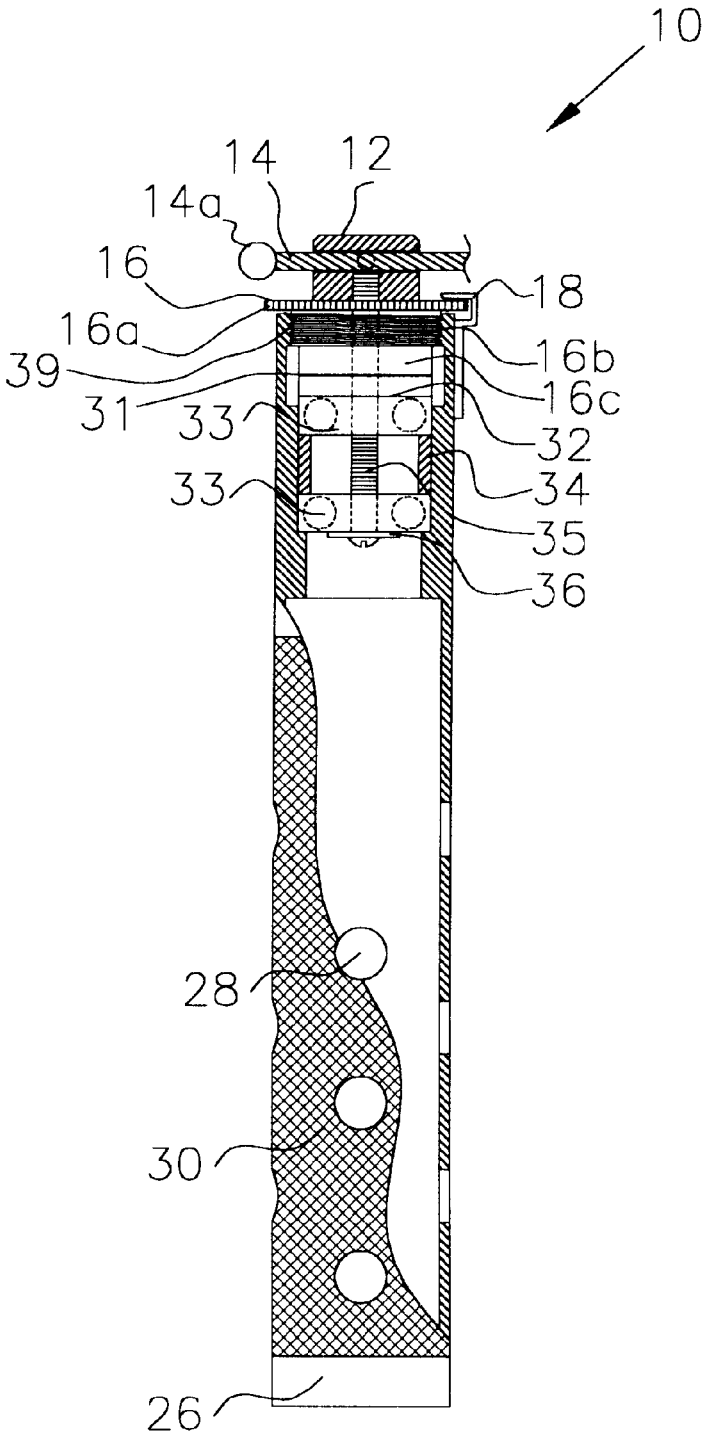
FIG. 3 is an elevational view, partially in section of a second embodiment including a braking assembly and the relationship to the flexible jump rope.
Figure 4:
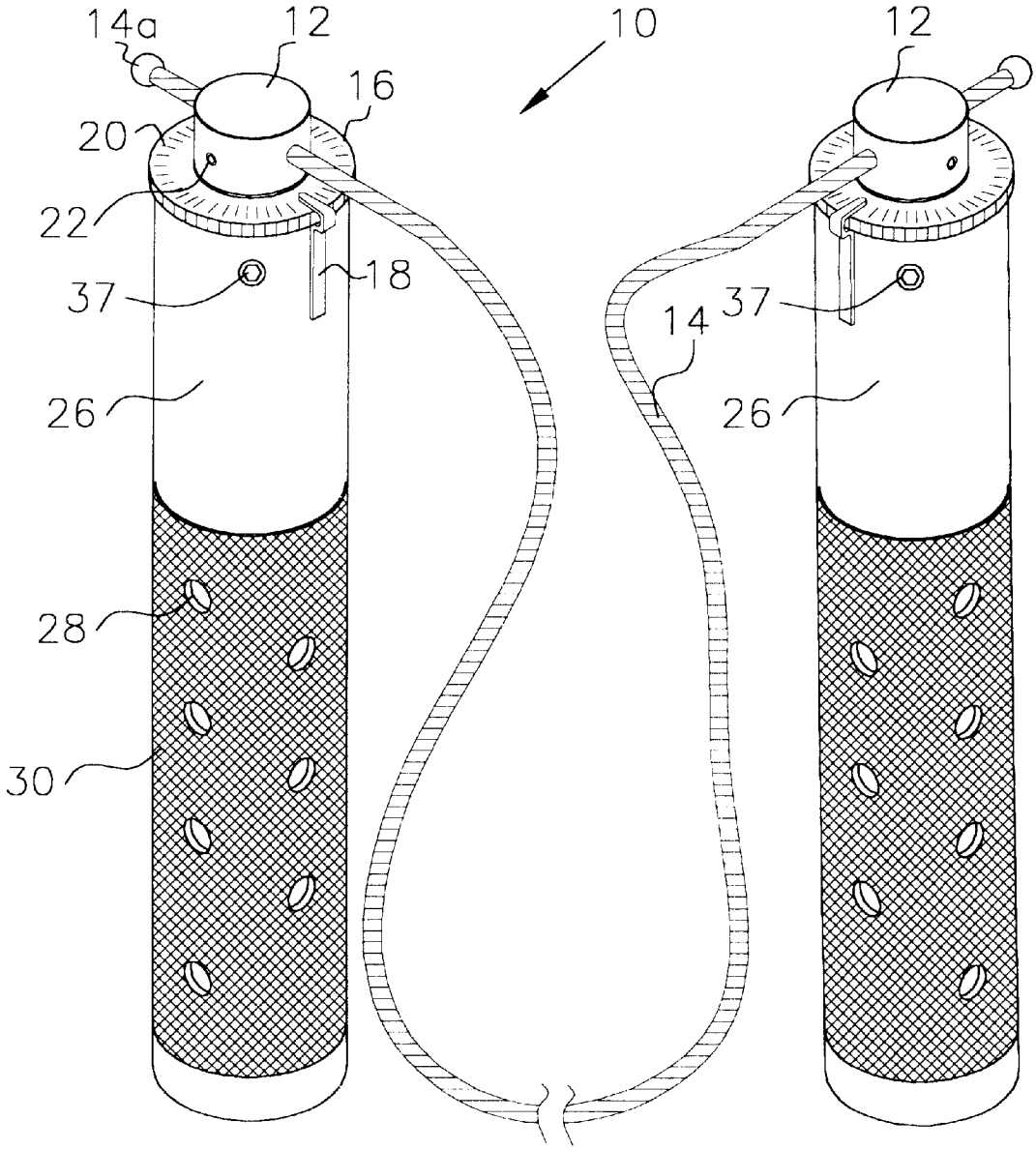
FIG. 4 is an isometric view of a second embodiment showing the braking assembly.

FIGS. 3 and 4 disclose a second embodiment having an identical bearing assembly as the first embodiment. In addition, the second embodiment includes a friction braking system to retard the speed of rotation when desired. The preferred embodiment is equipped to rotate as fast as the user selects, however, for slower maneuvers, a slower rotation is preferred. Knurling 16*a* enables threads 16*b* of cap 16 to be turned into screw threads 39 onto brake surface 32. Frictional face 31 between friction pad 16*c* and brake surface 32 provides a durable non binding, non ablatable surface. Index marks 20, radially arrayed upon the surface of cap 16 provide indentations by which spring pawl 18 engages and prevents random turning or loosening of cap 16.

Of course, it should be understood that a wide range of changes and modifications can be made to the preferred embodiment described above. It is therefore, intended that the foregoing descriptions be regarded as illustrative rather than limiting, and that it can be understood that it is the following claims, including all equivalents, which are intended to define the scope of the invention.

What is claimed is:

1. A speed ball bearing jump rope construction wherein rope length can be changed to accommodate users of different sizes so as to allow the users to adopt the most effective length, said jump rope construction comprising:

a first and a second hollow handle, each of said handles having a top end and a bottom end, each of said handles having a hole formed therethrough and having an external gripping surface, a threaded hole formed at a measured point from said top end, a plurality of vent holes formed in each of said gripping surfaces, a bearing assembly inserted in each of said handles, each of said bearing assemblies having a round shaped boss, said boss having a top surface, a bottom surface and an outer surface, a first hole formed through said outer surface, perpendicular to a center line drawn through said bearing assembly, a second hole formed through said outer surface, perpendicular to said first hole and intersecting said first hole at a midpoint of said boss, a third hole formed in said bottom surface parallel to said center line, said second and third holes each being threaded, a first bearing and a second bearing being assembled on opposite sides of a spacer, said bearing assembly being fastened together by a washer and screw fastened through said threaded third hole in said bottom surface, and said bearing assembly being inserted at said top end, within said hole formed through said handles, a jump rope having a first end and a second end, said first end being inserted through said first hole of said first hollow handle, and a second end being inserted through said first hole of said second handle, a crimp screw being inserted into each of said second holes for securing said jump rope ends in place, and a screw inserted into each of said threaded holes in said bottom surfaces of said bosses, said screws bearing on each of said spacers, thereby retaining each of said bearing assemblies fixed within the respective handles.

2. The speed ball bearing jump rope construction of claim 1 wherein a cap having indentations and a spring pawl are fastened at each of said top ends of said hollow handles and a brake surface is inserted between each of said bearing assemblies for retarding the speed of rotation as desired.

* * * * *